United States Patent [19]

Jacobsson

[11] 4,240,811

[45] Dec. 23, 1980

[54] FIXING AND CONNECTING DEVICE FOR WIRES AND PLATES IN ELECTROSTATIC FILTERS

[75] Inventor: Bertil Jacobsson, Lidköping, Sweden

[73] Assignee: Elfi Elektrofilter AB, Lidköping, Sweden

[21] Appl. No.: 47,912

[22] Filed: Jun. 12, 1979

[30] Foreign Application Priority Data

Jun. 22, 1978 [SE] Sweden ..... 7807173

[51] Int. Cl.[3] ..... B03C 3/08; B03C 3/12

[52] U.S. Cl. ..... 55/143; 55/145; 55/138

[58] Field of Search ..... 55/137, 138, 141, 143, 55/145; 211/153, 183

[56] References Cited

U.S. PATENT DOCUMENTS

| | | | |
|---|---|---|---|
| 2,380,992 | 8/1945 | Pegg et al. | 55/143 |
| 2,639,781 | 5/1953 | Savitz | 55/138 |
| 2,813,595 | 11/1957 | Fields | 55/137 |
| 3,016,980 | 1/1962 | Gonzalez | 55/137 |
| 3,040,498 | 6/1962 | Berly | 55/138 |
| 3,173,774 | 3/1965 | Getzin | 55/138 |
| 3,707,828 | 1/1973 | Borney | 55/138 |
| 3,800,509 | 4/1974 | Carr et al. | 55/138 |

FOREIGN PATENT DOCUMENTS

| | | | |
|---|---|---|---|
| 215344 | 6/1958 | Australia | 55/138 |
| 2341626 | 9/1974 | Fed. Rep. of Germany | 55/145 |
| 2714126 | 10/1977 | Fed. Rep. of Germany | 55/138 |
| 47-15989 | 11/1972 | Japan | 55/138 |

*Primary Examiner*—David L. Lacey

*Attorney, Agent, or Firm*—LeBlanc, Nolan, Shur & Nies

[57] ABSTRACT

Fixing and connecting device for wires and plates in electrostatic filter, where the charging section comprises two or more parallel wires between plates and the separation section comprises mutually parallel plates, with the device also comprising a frame consisting of two parallel gables fixed by two identical parallel spacing parts for supporting wires and plates in the charging section and including fore and aft suppporting legs intended to support the plates in the face and aft vertical corners of the separation section.

The gables and the supporting legs comprise slits and grooves for positioning wires and plates. According to a preferred embodiment there is a contact strip on each of the aft supporting legs where one of the contact strips connects every other plate in the separation section and the other contact strip connects intervening plates to two separate voltage levels.

The device brings about a simple mounting in respect of fixing, positioning and connecting of plates and wires.

6 Claims, 22 Drawing Figures

Fig. 15
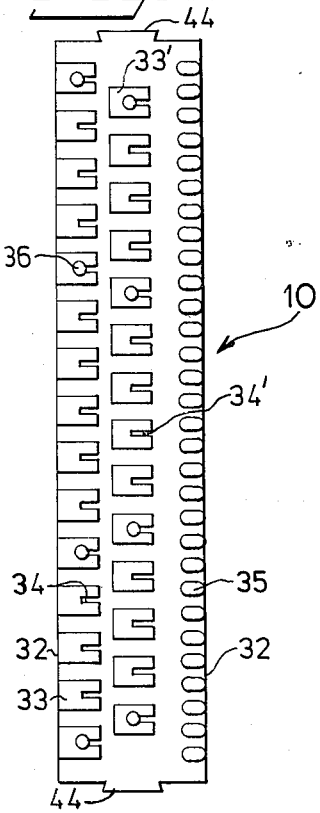
Fig. 16
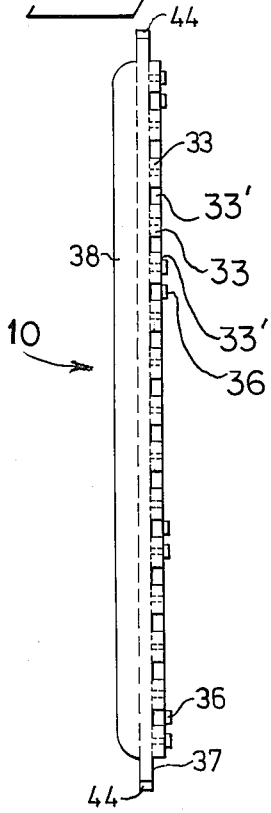
Fig. 18
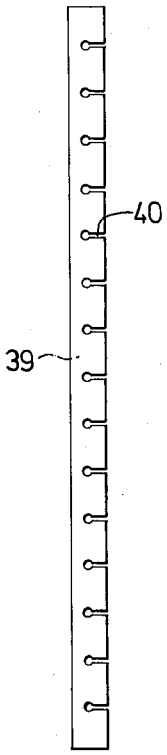
Fig. 17
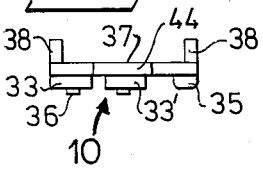
Fig. 19
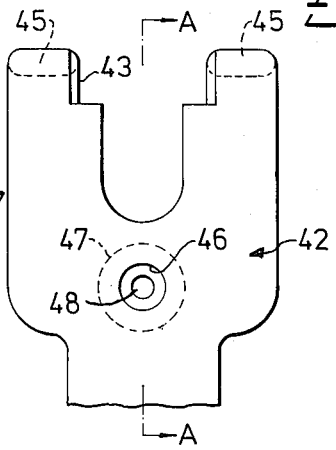
Fig. 21
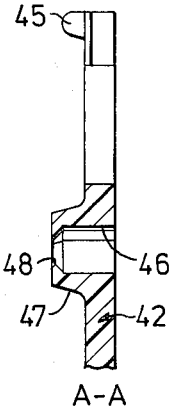
Fig. 22
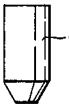
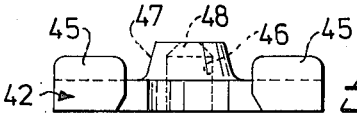
Fig. 20

FIXING AND CONNECTING DEVICE FOR WIRES AND PLATES IN ELECTROSTATIC FILTERS

The present invention relates to a device for fixing and connecting electrically conducting wires and plates in electrostatic filters—electric filters—for air cleaning.

The principle for electric filters for air cleaning is that particles arriving towards the filter, of which most are not electrically charged, during a first stage or section are charged when they pass between two electric conductors, as between a wire and two plates on either side of the wire where the plates and the wire have different potentials. A particle charged in such a way is then during a second stage or section separated between for example two plates which have different electric potentials in that the charged particle is attracted towards the one of the plates which has reverse polarity in relation to the particle.

In practice such an electric filter is made for example according to the U.S. Pat. application No. 968,770 (Rule 60 Cont. of Ser. No. 783,543, assigned to the assignee of the present application). In this case the charging stage or section comprises a greater number of mutually parallel plates and between them there are two or more wires mutually parallel and positioned halfway between the surrounding plates at a predetermined distance from each other in the direction of the movement of the particles. The separation stage or section comprises besides the already mentioned pairs of plates also an odd number of mutually parallel plates positioned between the already mentioned plates and parallel with these so that the distance between any two adjacent plates in the separation stage or section has a predetermined value.

The plates and the wires are further electrically connected in such a way that the wires have reversed polarity in relation to the plates in the charging stage or section so that two adjacent plates in the separation stage or section have reversed polarity in relation to each other.

By an electric filter according to the aforedescribed patent application, a very great part of the amount of incoming particles are separated out, nearly 100%. In order to achieve this result the wires and the plates must be fixed and positioned very precisely in order that the mutual distances between the wires, between the plates and between the plates and the wires be predetermined. This is also important as the risk for and the possibility of flash-over must be small.

The present invention refers thus to a fixing and connecting device for wires and plates in electric filters, where the charging section comprises two or more wires between each pair of plates, with said wires mutually parallel and each placed halfway between said pair of plates, and where the separation section comprises mutually parallel plates, where each plate has a different electric potential than that of adjacent plates.

The invention is characterized by the fact that two equal gables are positioned parallel and spaced from each other fixed by two equal and mutually parallel spacing parts between the ends of said gables arranged to constitute a frame with quadrangular and preferably rectangular cross section, by the fact that each gable in its two longest sides is provided with a number of slits perpendicular to the longitudinal direction of said sides, and by the fact that the distance between adjacent slits is the same for all slits, in which slits a wire wound to and fro between said gables is intended to be introduced in such a way that the turns (which have been previously referred to as "wires") of the wire will be mutually parallel as already stated, by the fact that the inner sides of said gables comprise pairs of projections forming grooves perpendicular to the longitudinal direction of the two longest sides, in which grooves the said plates in the charging section are intended to be introduced, and by the fact that fore and aft supporting legs are present in the fore and aft respective corners in the separation section.

The invention will be described more in detail with reference to the attached drawings, where FIG. 1 schematically shows a device according to the invention.

FIG. 2 shows a gable included in the invention and seen from the inner side of the gable.

FIGS. 3 to 5 inclusive show cross sections of said gable as illustrated at A—A, B—B and C—C respectively, in FIG. 2.

Figure 9:
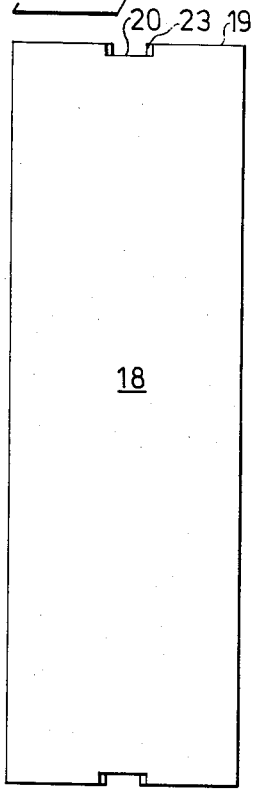
Figure 11:
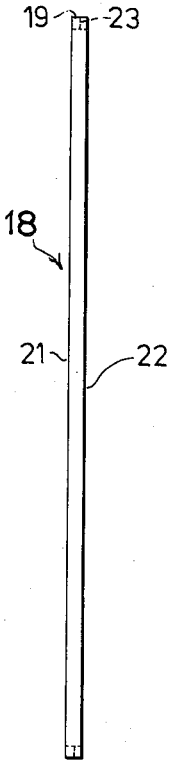
Figure 10:
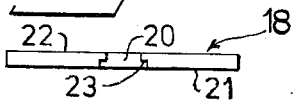

FIGS. 9 to 11 inclusive show the side plan, end and side edge views, respectively of an outer gable according to the present invention.

Figure 1:
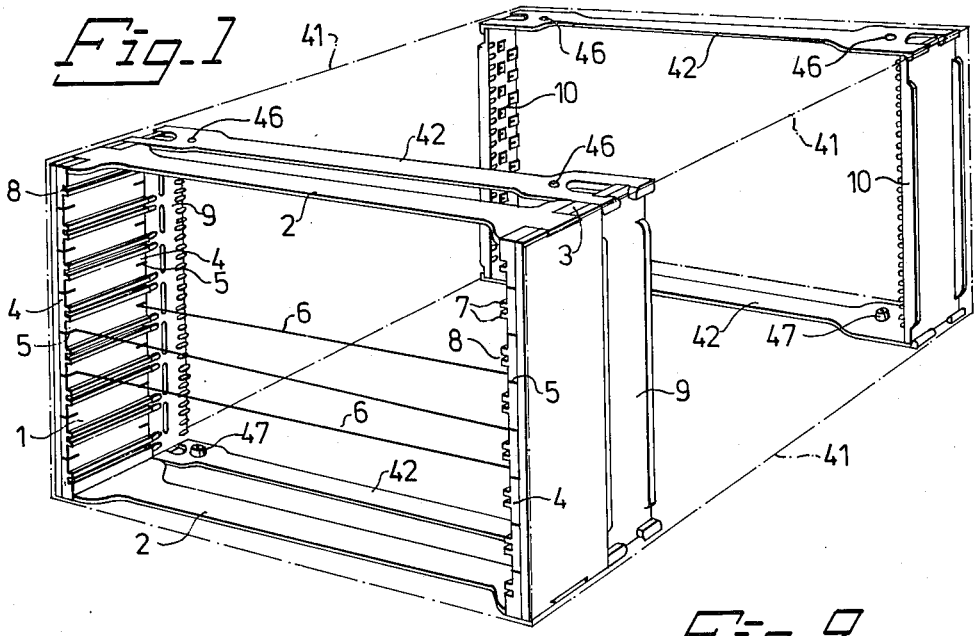
Figure 12:
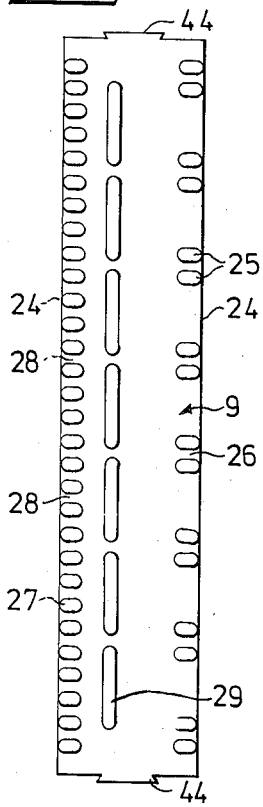

FIG. 12 shows a fore supporting leg according to the invention seen from the inner side of the supporting leg, shown in FIG. 1.

Figure 13:
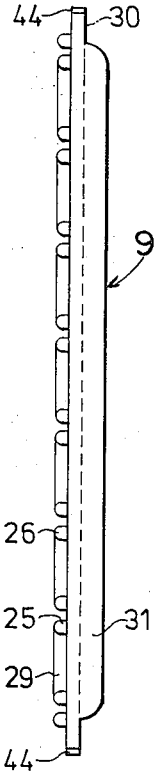

FIG. 13 shows a fore supporting leg according to FIG. 12 and seen from the right in FIG. 12.

Figure 14:
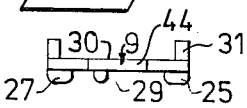

FIG. 14 shows a fore supporting leg according to FIG. 12 and FIG. 13 see from below in FIG. 12.

FIG. 15 shows an aft supporting leg according to the invention and seen from the inner side of the supporting leg, shown in FIG. 1.

FIG. 16 shows an aft supporting leg according to FIG. 15 seen from the left in FIG. 15.

FIG. 17 shows an aft supporting leg according to FIG. 15 seen from below in FIG. 15.

FIG. 18 shows a contact strip according to the invention.

FIG. 19 shows one end of a mounting strip according to the invention and seen from the inner side of said mounting strip shown in FIG. 1.

FIG. 20 shows the mounting strip according to FIG. 19 and seen perpendicularly to one end of said strip.

FIG. 21 shows a cross section through the mounting strip according to Section A—A of FIG. 19.

FIG. 22 shows a guide pin according to the invention.

GENERAL DESCRIPTION

In FIG. 1 which thus schematically shows a device according to the invention there are two similar gables 1 which are positioned parallel to each other and spaced from each other and fixed by two similar and mutually parallel spacing parts 2 between the ends 3 of said gables and arranged to form a frame with a quadrangular and preferably rectangular cross section.

Each gable 1 is in its two longest sides 4 provided with a number of slits 5 perpendicular to the longitudinal direction of said sides 4. The distance between adjacent slits 5 is the same for all slits 5. A wire 6 is intended to be introduced in the slits 5 in such a way that the wire 6 is wound to and fro between the gables 1 in such a way that such parts or stretches of wire 6 that are arranged between the gables 1 are mutually parallel. In FIG. 1 only a portion of the continuous wire 6 has been marked. The individual stretches of wire 6 are referred herein to wires between plates or mutually parallel wires.

The inner sides of the gables 1 include pairs of projections 7 forming grooves 8 perpendicular to the longitudinal direction of said longest sides 4. The plates in said charging section are intended to be introduced and supported in said grooves. These plates have not been shown in FIG. 1.

Adjacent to the gables 1 and to the right as seen in FIG. 1 there are fore supporting legs 9 which are included in the said separation section. They are thus positioned in the front corners of the separation section. In the back corners of the separation section there are aft supporting legs 10. The shape of said fore and aft supporting legs will be described in connection with FIGS. 12–14 and 15–17 respectively.

FIGS. 2 to 6 inclusive show the shape of the gables 1 more in detail. Each gable has in its two ends 3 dovetail slots 11. The gables 1 also near one end have a through hole 12 (see FIGS. 2 and 3) positioned between the two grooves 8 that are nearest to said end. In the hole 12 in one of said gables 1 the two ends of said wire 6 and a contact terminal 12*a* (FIG. 3) for connection to a voltage source are attached by a rivet 12*b* or in another appropriate way. There is thus electric contact between the wire 6 and said contact terminal.

Figure 2:
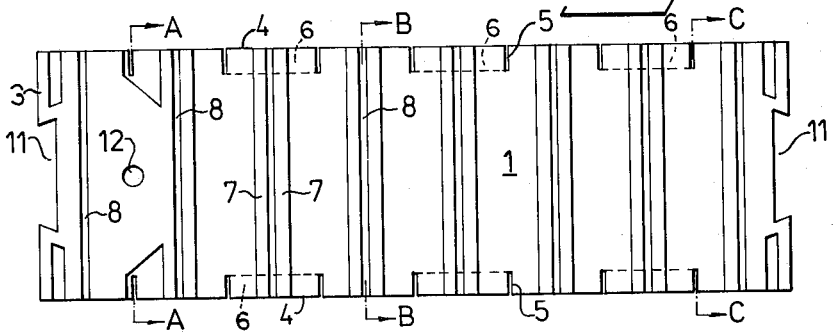
Figure 3:
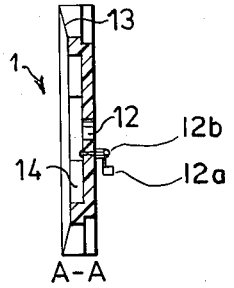
Figure 4:
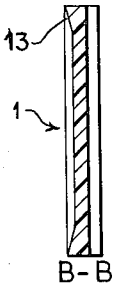
Figure 5:
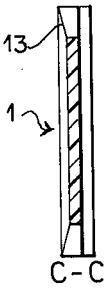

FIGS. 3 to 5 inclusive each shows a a different cross section through a gable 1. in FIG. 3, 13 denotes a raised part provided along the two longest sides 4 and on the outer side of the gable. The raised part is intended to be a structure such that the wire 6 wound between the gables does not glide away. In FIG. 2, as indicated by dotted lines, such sections of the wire 6 have been marked that are in contact with the gable 1 in FIG. 2. The other sections of the wire 6 are thus to be found as well between the gables 1 as in contact with both gables as seen in FIG. 1.

Figure 6:
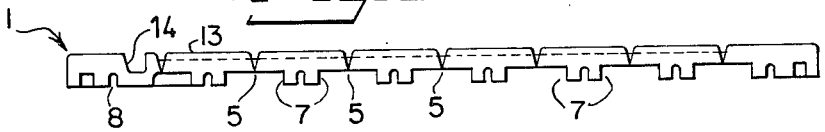
FIG. 6 shows the said gable seen perpendicularly to one of its longest sides.

In FIGS. 3 and 6, 14 denotes a recess in the outer side of said gable 1 for accomodating an electric line from said contact terminal.

Figure 7:
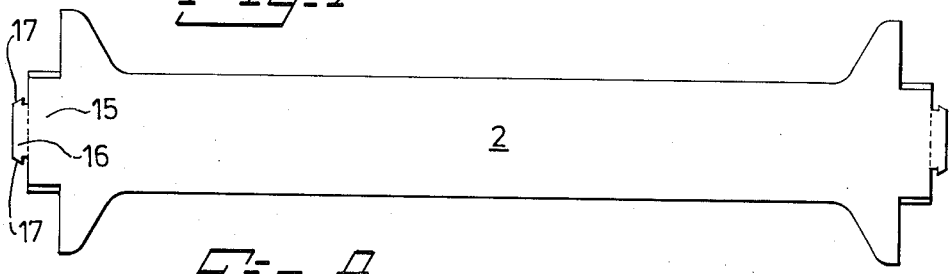
FIG. 7 shows a spacing part included in the invention as seen from the outside of the spacing part, e.g., the top side of the upper spacing part seen in FIG. 1.
Figure 8:
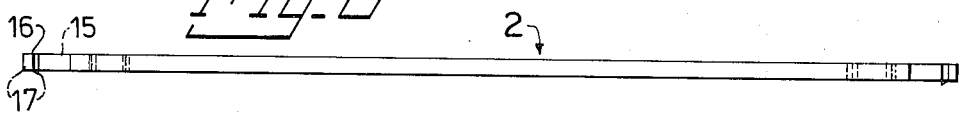
FIG. 8 shows said spacing part seen perpendicularly to one of its longest sides.

In FIG. 7, 15 denotes the ends of the spacing part 2 and said ends have a dovetail cross section. The ends 15 are intended to fit into the dovetail slots in the ends of the gables. The middle part 16 of the ends 15 protrude 1 to 2 millimeters and has on its sides and on its lower surface, shoulders 17.

In FIG. 9 an outer gable is denoted by 18 and said outer gables 18 are intended to be attached to the outer side of the gables 1. In the ends 19 of said outer gables 18 there is a groove 20 halfway on the ends. The groove is a little wider at the outer side 21 of the gable than at the inner side 22 and has notches 23 in the direction of the thickness of the outer gable. In the groove 20 the protruding part 16 of the end 15 of the spacing part 2 is intended to be introduced. The outer gable 18 is hereby fixed to the spacing part 2 as the shoulders 17 on part 16 of spacing member 2 cooperate with the groove 20 and its notches 23.

In FIGS. 12 to 14 inclusive the shape of the fore supporting legs 9 belonging to the separation section is shown.

The fore supporting legs 9 have on their inner side a line of equally spaced projections 25 parallel to the two longest sides 24 of the supporting leg. The line of projections is arranged along that side of the supported leg that is intended to connect to the charging section. The pairs of projections 25 form grooves 26 perpendicular to the sides 24 and in these grooves the said plates in the charging section are intended to be introduced.

Along and parallel to the remaining of said two longest sides 24 there are on the inner side of the supporting leg provided a line of projections 27 and said projections 27 form grooves 28 going perpendicular to the sides 24. In said grooves 28 said plates in the separation section are intended to be introduced.

The inner side of the supporting leg has between the said two lines of projections 25 and 27, a third line of projections 29 parallel to the said two lines of projections and the projections 29 are arranged as end stops for the plates in the separation section. The outer side 30 of the supporting leg has two spacing ribs 31 parallel to the sides 24.

In FIGS. 15 to 17 inclusive the shape of the aft supporting legs 10 belonging to the separation section is shown.

The aft supporting legs 10 have on their inner sides a fore and an aft line of projections 33 equidistant positioned and parallel to the two longest sides 32 of the supporting leg and having a C or U-shape. The U-shaped projections 33 form short grooves 34 perpendicular to the sides 32. In these grooves 34 the plates in the separation section are intended to be introduced, and the bottoms of the grooves 34 are also end stops for said plates. The middle line of projections 33′ which form grooves 34′ are displaced, in the direction of the lines of projections 33 and 33′, a distance of half the distance between two in the other line of adjacent projections 33. Along and parallel to that of the sides 32 intended to be situated nearest to the charging section the inner side of the supporting leg 10 has a line of projections 35 arranged in the same way and for the same purpose as the projections 27 on the fore supporting legs 9.

On four of the U-shaped projections (33,33′) in each line there are shoulders 36.

The outer side 37 of the aft supporting legs 10 has two spacing ribs 38 parallel to the sides 32.

In FIG. 18, 39 denotes a contact strip intended to be provided on and along one of the lines of U-shaped projections 33 and 33′ on the aft supporting legs 10. The contact strip 39 is intended to be attached in a suitable way to the shoulders 36. The contact strip 39 has slits 40 perpendicular to the longitudinal direction of the contact strip 39. Plates in the separation section are intended to be introduced in such slits 40. The slits 40 have a width in the longitudinal direction of the contact strip 39 that is somewhat less than the thickness of said plates. In this way a good electric contact between plates and contact strip as well as a locking of the plate in each slit 40 will be had. The slits 40 are thus intended to be arranged opposite said grooves 34 in the U-shaped projections 33.

Contact strips 39 are intended to be arranged on said fore line of U-shaped projections 33′ on one of the aft supporting legs 10 and on the aft line of U-shaped projections 33 on the other aft supporting leg 10 or vice versa.

In FIGS. 19 to 21 inclusive, 42 denotes a mounting strip and such mounting strips are intended to be spacing and fixing parts between the two fore supporting legs themselves and between the two aft supporting legs, as is shown in FIG. 1. In FIG. 19 only one end of said mounting strip 42 is shown. The mounting strip 42 has at both its ends dovetail slots 43 parallel to the longitudinal direction of the mounting strip. Said slots are arranged in such a way that a dovetail 44 on each of the end surfaces of the supporting legs 9,10 will fit in the slot 43. The mounting strip 42 further has shoulders 45 at each side of the slot 43. The shoulders are intended to fit, when connected, over an end surface of a supporting leg 9,10 so that fixing results.

A boss 47 with a circular hole 46 is arranged near each of the ends of the mounting strip 42 and in such a way that the bosses after the assembling of a filter will be found on the inner side of the filter with the circular holes opening at the outside of the filter. The circular hole 46 has its bottom tapered as a bevel 48.

In FIG. 22 is shown a guide pin 49 to fit in the hole 46.

In order that an electric filter will show a high efficiency there may, as is said in said patent application, be provided three plates in the separation section between each pair of plates in the charging section, with said plates being common to the charging section and to the separation section and thus going through. Thus there is a great number of plates in the separation section, for example 29, and also in the charging section, for example 8. The number of mutually parallel wires is 14. To this comes, as is evident from the foregoing and from the said patent application, that two adjacent plates in the separation section should have different potentials and the wires (stretches of wire 6) in the charging section should have a third potential.

With the device according to the invention the electric filter is assembled very simply.

The gables 1 and the spacing parts 2 are put together and the wire 6 is wound on and is fastened by a rivet or in another suitable way. The outer gables 18 are then attached. On each of the two aft supporting legs 10 a contact strip 39 is mounted in a way already stated.

The throughgoing plates are introduced in the grooves 8 in the gables and in the therefore intended grooves 26,28 in the fore and aft supporting legs between the projections 29 and in the therefore intended grooves in the aft supporting legs 10. The other not throughgoing plates are introduced in the therefore intended grooves in the fore and aft supporting legs. The aft supporting legs 10 as well as the fore supporting legs 9 are mutually fixed with the aid of the therefore intended mounting strips 42.

Thereafter the device is pushed into a box 41, shown by phantom lines in FIG. 1 and for example made of aluminium, with the spacing rims 31,38 fitting against the inside of the box, whereby the structural components in the device are mutually locked.

Then the said contact terminal and the two contact strips are connected to three different voltage levels.

When larger filter units are wanted the bosses 47 with their holes on the mounting strips 42 together with the guide pins 49 are used. Several filter units are stacked on each other and are fixed in relation to each other by means of the holes 46 and the guide pins 49. Several piles may be placed beside each other. All the units are then pushed into a larger box corresponding to the box 41 shown by chain-dotted lines in FIG. 1. The filter units are electrically connected in parallel and are arranged in such a way that connection is made to only one unit. In this way it is possible to build up different filter sizes by means of a fundamental unit.

In order to get good insulation the said structural components are preferably made of plastic.

From the proceeding description it is evident that the device according to the invention provides the possibilty to fix, position and connect a great number of plates and wire sections in an electrostatic filter in a sample way. This is done in the device with use of very few numbers of separate structural components.

The invention is not to be considered to be limited to the described and shown embodiment but may be varied within the frame given by the attached claims.

I claim:

1. A fixing and connecting device for use in an electrostatic filter configuration which includes a charging section and a separation section and uses wires and plates as charging and collecting components and the charging section has two or more wire stretches between each pair of plates, the wire stretches are mutually parallel and each positioned halfway between the pairs of plates, and the separation section has mutually parallel plates with each plate having a different potential than the adjacent plates, said device for fixing the wires and plates, comprising: two identical gable components positioned parallel to and spaced apart from each other; two identical and mutually parallel spacing parts fixed to and between the ends of said gables provide a frame with quadrangular cross section; each gable in its two longest side edges being provided with a number of slits perpendicular to the longitudinal direction of said side edges; the distance between two adjacent said slits being the same for all slits; said slits enabling a length of charging wire to be wound to and fro with wire stretches between said two gables to enable the stretches of wire to be parallel and the inner faces of said gables comprise pairs of projections forming grooves between pairs of said slits and perpendicular to the longitudinal direction of said two longest side edges, said grooves enabling plates for the charging section to be received therein and further including fore and aft pairs of spaced apart supporting leg components behind said frame, each pair spaced from the other to constitute the fore and aft corners of a separation section.

2. A device according to claim 1, comprising a contact terminal, for connection to a voltage source, secured to one of said two gable components and enabling connection thereto of the ends of the charging wire.

3. A device according to claims 1 or 2, wherein each of said aft supporting legs includes on its inner face fore and aft parallel lines of spaced-apart U-shaped projections forming short grooves perpendicular to the longest side edges, into which short grooves the plates for the separation section are adapted to be inserted, the bottoms of the U-shaped projections providing end stops for the plates; said projections in each line being displaced from adjacent projections a distance corresponding to half the spacing distance between projections in the other line; and a contact strip is positioned on and along one of said lines of projections, said contact strip providing means to electrically engage the plates and enabling connection to a voltage source.

4. A device according to claim 3, wherein said contact strip is arranged on and along the said forward line of U-shaped projections on one of said aft supporting legs and further including another one of said contact strips which is arranged on the aft line of said U-shaped projections on the other of said aft supporting legs; each of said contact strips enabling connection to an individual different voltage level.

5. A device according to claim 4, wherein each of said contact strips along one of its two longest side edges has a number of slits perpendicular to said longest side edge and uniformly spaced-apart along the side edge, said slits spaced-apart so that they are positioned adjacent the short grooves in said U-shaped projections so that when plates are introduced into the separation section the plates are adapted to fit into the slits; the width of said slits being slightly less than the thickness of the plates to be inserted, to enable a tight fit.

6. A device according to claim 1, wherein each of said fore supporting legs, on its inner face has, near one of its side edges, a line of uniformly spaced apart pairs of projections forming open ended grooves therebetween perpendicular to said longest side edges and adapted to receive the plates for the charging section; said inner face of each of the fore supporting legs near the other of its said longest side edges having a parallel line of projections forming open ended grooves perpendicular to the side edge, and adapted to receive the plates for the separation section; and said inner side face of each said fore supporting leg, between the two said lines of projections including a third parallel line of projections arranged to form end stops for plates of the separation section.

* * * * *